United States Patent [19]

MacCraven

[11] 4,431,168

[45] Feb. 14, 1984

[54] APPARATUS FOR IMPROVED HEAT TREATMENT OF ELONGATED ALUMINUM ALLOY MATERIALS

[75] Inventor: Joseph MacCraven, Bremen, Ga.

[73] Assignee: Southwire Company, Carrollton, Ga.

[21] Appl. No.: 332,992

[22] Filed: Dec. 21, 1981

[51] Int. Cl.[3] ..... C21D 9/62

[52] U.S. Cl. ..... 266/104; 266/107; 266/111; 266/112; 266/106; 432/59

[58] Field of Search ..... 266/102, 103, 104, 106, 266/90, 92; 148/156; 432/8, 59, 45; 226/38, 195; 72/286, 280, 289; 219/188

[56] References Cited

U.S. PATENT DOCUMENTS

| | | | |
|---|---|---|---|
| Re. 28,419 | 5/1975 | Schoerner | 148/200 |
| Re. 30,465 | 12/1980 | Schoerner | 428/606 |
| 563,462 | 7/1896 | Edison | 219/154 |
| 1,607,675 | 11/1926 | Jeffeires | 219/10.41 |
| 2,040,343 | 5/1936 | Sindns et al. | 219/10.41 |
| 2,203,946 | 6/1940 | Doescher | 242/45 |
| 2,309,745 | 2/1943 | Bergin | 148/6.14 R |
| 2,589,283 | 3/1952 | O'Grady | 219/155 |
| 2,622,860 | 12/1952 | Lorig | 432/8 |
| 2,965,368 | 12/1960 | McIluried | 148/156 |
| 3,045,094 | 7/1962 | Coscia et al. | 219/10.41 |
| 3,154,442 | 10/1964 | Nye et al. | 266/106 |
| 3,264,143 | 8/1966 | Turner | 148/11.5 A |
| 3,385,946 | 5/1968 | Hatchard | 219/10.47 |
| 3,418,177 | 12/1968 | Pryor | 148/11.5 R |
| 3,486,947 | 12/1969 | Pryor et al. | 148/11.5 A |
| 3,512,221 | 5/1970 | Schoerner | 428/606 |
| 3,647,562 | 3/1972 | Schoerner | 148/2 |
| 3,670,401 | 6/1972 | Schoerner | 164/160.2 |
| 3,830,478 | 8/1974 | Pietroni | 266/104 |
| 3,857,673 | 12/1974 | Andrus | 432/59 |
| 3,964,935 | 6/1976 | Wilks | 148/2 |
| 3,967,983 | 7/1976 | Chia et al. | 148/2 |
| 4,028,141 | 6/1977 | Chia et al. | 148/2 |
| 4,066,477 | 2/1978 | Bockenhoff et al. | 148/15 |
| 4,080,222 | 3/1978 | Schoerner et al. | 148/2 |
| 4,183,771 | 1/1980 | Setzer et al. | 148/2 |
| 4,192,693 | 3/1980 | Chia et al. | 148/2 |

FOREIGN PATENT DOCUMENTS

| | | | |
|---|---|---|---|
| 53-3025217 | 8/1978 | Japan | 148/156 |

OTHER PUBLICATIONS

Sublett, "Thermal Treatment Pertaining to Aluminum Production", *Wire and Wire Products,* vol. 40, No. 11, Nov. 1965, pp. 1766–1769, 1801–1803.

Sublett, "Thermal Treatment of Aluminum Wire for Mechanical Applications", *Wire Technology,* 11/12/77, pp. 45–49.

*Primary Examiner*—L. Dewayne Rutledge
*Assistant Examiner*—Christopher W. Brody
*Attorney, Agent, or Firm*—Herbert M. Hanegan; Stanley L. Tate; Robert S. Linne

[57] ABSTRACT

A method and apparatus for heat treating and especially annealing of elongate metallic materials such as wire wherein the wire (24) given a longer length exposure to complete the heat treatment of the wire at higher line speeds. This is accomplished either by adding a heated storage chamber (41) holding a great length of wire (24) in sequence with conventional or modified annealing apparatus, or by substitution of a special apparatus (100) for the existing conventional annealing apparatus.

6 Claims, 4 Drawing Figures

APPARATUS FOR IMPROVED HEAT TREATMENT OF ELONGATED ALUMINUM ALLOY MATERIALS

TECHNICAL FIELD

The present invention relates to the metallurgical arts, and more specifically to an improved method and apparatus for continuously heat treating aluminum alloy rod and wire or the like following working of the cast bar or billet.

BACKGROUND OF THE INVENTION

Improved aluminum alloy electrical conductors were developed and refined throughout the 1970's including Triple-E® for building wire and alloy 6201 for overhead conductors among many others. The especially useful properties of the various alloy conductors are generally achieved through combinations of working the metal and thermal treatments. It is to the latter manufacturing operation that this invention is directed.

Of the various thermal treatments by which the alloy rod or wire properties are achieved, this invention is most useful in homogenization, solution heat treating (or solutionizing), annealing, and precipitation treating (or aging), and especially useful for annealing alloy wire.

Homogenization is a high temperature soaking treatment to eliminate or reduce segregation by diffusion, obtaining thereby a uniform structure and an even distribution of alloying constituents; it has been described as particularly applicable for those aluminum alloys having up to 12% alloying constituents. Often, homogenization consists of heating to near the eutectic melting point and maintaining this temperature for up to several hours. A stronger, more ductile (and homogeneous) structure may result if homogenization is properly performed.

Generally, the term "solution heat treating" is applied when an alloy is heated at a given temperature for a given time in order to allow soluble constituents to enter into solid solution, where they are retained in a supersaturated state after quenching. A solution heat treated aluminum alloy, suitably quenched and with subsequent treatments, can provide high mechanical properties such as tensile strengths greater than 90,000 $lbf/in^2$ and shear strengths of 50,000 $lbf/in^2$.

Annealing, the thermal treatment for which one embodiment of present invention is particularly appropriate, is the heating of the alloy to about the recrystallization temperature and maintaining the desired temperature for a particular desired period of time, after which the alloy is cooled or quenched. Annealing is often used to soften metal by removal of stress resulting from cold working or by coalescing precipitates from solid solution.

Precipitation treating, or aging, is of two types, natural (usually at room temperature) or artificial (usually at elevated temperatures). Aging gives certain alloys maximum strength and may be performed in coordination with certain solution heat treatment procedures. Aging comprises the precipitation of small particles from solid solution under controlled temperatures.

Various aluminum products are used as electrical conductors, including EC (electrical conductor grade) and various alloys including Triple E®, Super T®, NiCo®, the Aluminum Association 1350, 5005, 6101, 6201, and others. Electrical conductivity standards from about 50 percent of IACS (International Annealed Copper Standard) to about 62% of IACS are common, depending on the alloy and use intended. Certain alloys, for example the proprietary Triple E aluminum conductor alloy require careful preparation to achieve their most desirable properties. Ordinarily, high iron aluminum alloys may be manufactured continuously and certain production economies associated therewith are obtained; see U.S. Pat. No. Re 28,419 (Reissue of U.S. Pat. No. 3,512,221) and others of this family.

In producing many of these aluminum alloys, and especially the high-iron such as Triple E alloys, a continuous casting machine serves as a means to solidify the molten aluminum alloy metal into a cast bar product which is subsequently hot-formed into an elongated rod or other intermediate product. The hot forming may be used to impart substantial movement to the cast bar along a plurality of angularly disposed axes. For illustration but not limitation, the casting machine may be of the wheel/band type including a rotating casting wheel having in the periphery thereof a groove partially closed by an endless band. The wheel and band cooperate to provide a mold, into one end of which molten metal is poured to solidify, and from the other end of which the cast bar is emitted in substantially that condition in which it was solidified. The cast bar is often conveyed directly into a rolling mill.

The rolling mill is of a conventional type having a plurality of roll stands arranged to hot-form the cast bar by a series of deformations. By rolling the cast bar substantially immediately upon extraction from the casting machine, the cast bar remains at a hot-forming temperature within a range of hot-forming temperatures. The cast bar may, however be adjusted by thermal treatment, as desired, by appropriate apparatus. The rolling mill reduces the bar cross section and elongates it to produce a rod product having a smaller cross section.

Rolled alloy rod such as is produced according to the foregoing is then processed in a reduction operation designed to produce continuous lengths of wire having various diameters, such as by drawing operations. Such drawing includes passing the rolled rod product through a successive series of progressively constricted dies to form the wire of desired diameter. Alternatively, the rod may be rolled down to smaller (wire) diameters. At the conclusion of the cross section reduction process, and intermediately during the process with certain alloys, the wire product may be subjected to one of the foregoing thermal treatments to achieve a desired combination of as-drawn properties. With certain alloy conductor materials such as Triple-E, the unannealed rod (F temper) is cold drawn without intermediate anneals, resulting generally in a wire product having very high tensile strength, and low conductivity and/or ultimate elongation properties.

Thence may follow one or more thermal treatments in the ordinary course of manufacturing operations. In the production of many electrical conductor alloys, the thermal treatment given is annealing, which may be performed in a batch furnace, or continuously, as by electrical resistance annealing, induction annealing, convection annealing, or radiation annealing. Among these thermal treatment operations, in-line continuous annealing is the most productive and energy efficient if carefully performed. Electrical resistance annealing, if possible, would be the most effective and easiest to accurately control, as is necessary to accommodate variations in line speed. Conventional apparatus, however, are unequal to the task as either unacceptably long catenaries of wire must be heated, unacceptably slow line speeds, or incompletely annealed wire results due to insufficient annealing at high line speeds. Further, electrical sparking at the wire-to-contact sheave contact surface results at high line speeds, causing wire surface pitting, sheave contact surface pitting, and aluminum buildup thereon. Finally, wire breakage due to high electrical current levels is a continuing problem at the high line speeds necessary for economic thermal treatments. This is especially true unless the peak-to-average voltage ratio is minimized, a further advantage of which is reduced sparking. Other problems encountered with conventional electrical resistance annealers used as in-line continuous thermal treatment apparatus include poor sheave contact surfaces, wire vibration (due to the high tensile strength and associated low bendability as well as electromagnetic field interaction), voltage losses at contact points which cause control problems, and oil and aluminum dust buildup on contact sheave surfaces which increase resistive losses and sparking.

DISCLOSURE OF INVENTION

The present invention solves these and other problems by the use of a special device to lengthen the duration of the thermal treatment applied to the drawn wire and the added process step of holding the wire at a selected elevated temperature for a selected time to ensure that the desired mechanical and electrical properties are achieved in the finished wire product. With most electrical conductor grade alloys there is a range of temperature/time relationships during which a given size wire of the particular alloy will reach the desired characteristics. With high-iron alloys, and especially with Triple-E alloy (from about 0.3 to about 0.95 weight-percent iron) a temperature range of from about 650° F. to about 850° F. for a time of from about 60 seconds to about 10 seconds, respectively, has been determined appropriate for annealing. At higher temperature and/or longer periods conductivity and/or strength decreases, probably due to the iron going back into solution, while at lower temperatures and/or shorter periods the conductivity and/or elongation will not be acceptable.

BEST MODE FOR CARRYING OUT THE INVENTION

Figure 1:
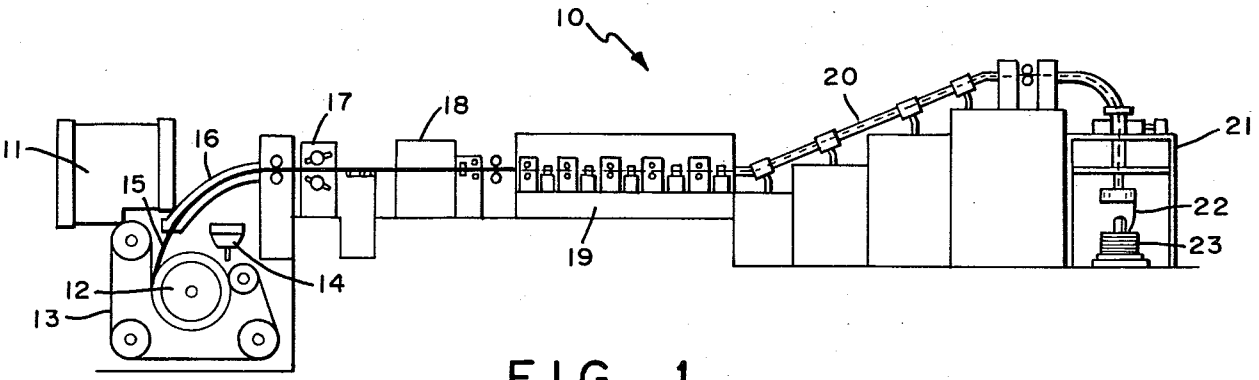
FIG. 1 is a simplified diagram of an exemplary system for continuous casting and rolling of molten metals, which may include heat treatments of the solidified metal at various stages in the production process (not shown).

Referring to FIG. 1, a continuous casting and rolling apparatus 10 is shown, in which molten metal is supplied to pour pot 14 by melting/holding furnace 11, poured into a mold formed by a peripheral groove in a rotating casting wheel 12 and casting band 13 which encloses a portion of the periphery of the wheel. Coolant (not shown) is applied to the closed portion of the mold to solidify the molten metal, forming a cast bar 15, which is guided by cast bar conveyor 16 away from the casting machine to subsequent operations. Shear 17 may be used to sever sections of the cast bar 15, as may be required during ordinary manufacturing operations. The cast bar 15 is routed through prerolling station 18 which may contain an initial bar heat treatment apparatus (not shown) and is then directed into the rolling mill 19, in which a plurality of roll stations work the metal, reducing its cross section and elongating it. Delivery pipe 20, in which thermal treatment may be performed, guides the thus-formed continuous cast and rolled rod product to a coiler station 21, where the rod 22 is collected into coils 23 for convenient handling, and storage or shipping.

The rod is then further reduced in cross section and lengthened into a smaller elongated product such as wire, as by drawing it in a conventional drawing machine or rolling in a conventional micro-mill. The metal may be subjected to various intermediate thermal treatments while being reduced in cross section.

Figure 2:
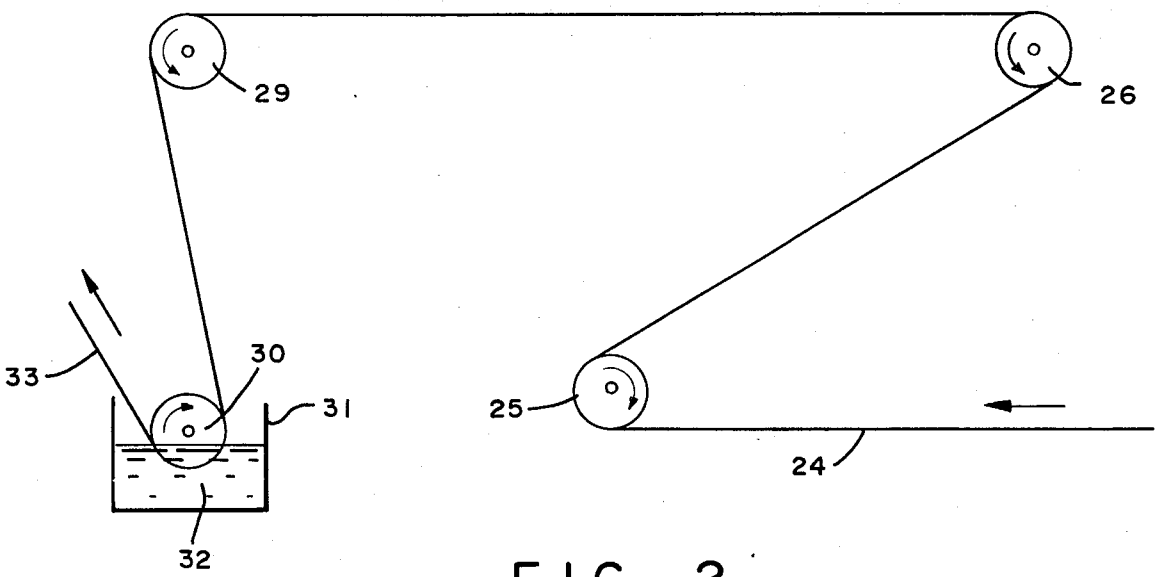
FIG. 2 is a simplified diagram of an ordinary system for heat treating elongated flexible products after drawing or rolling of the intermediate rod product.

According to the prior art methods, the as-drawn wire may be wound on bobbins and batch annealed, or subjected to conventional in-line electrical resistance annealing, see FIG. 2. In a conventional in-line electrical resistance annealer, as-drawn wire 24, FIG. 2, enters the anneal station and partially traverses a first rotating sheave 25. The wire is tensioned and advanced along a predetermined path to and partially around a second rotating sheave 26, through which electrical contact is made to an electrical current source (not shown). From the second sheave 26 the wire is passed to and around a third rotating sheave 29, through which electrical contact is made to the electrical current source (not shown), thereby completing an electrical current path through the wire. First sheave 25 and third sheave 29 may be electrically connected. The as-drawn wire 24 is thus heated by electrical current to an annealing temperature between first and second sheaves (25, 26) and maintained at about said temperature for the duration of its catenary traverse between second rotating sheave 26 and third rotating sheave 29. Subsequently the wire may be advanced further along its predetermined path of travel to and partially around quench roll 30, which may be immersed in a quench fluid 32 such as water or oil contained in a quench trough 31. In practice peak wire temperature occurs before quench roll 30. The annealed and quenched wire 33 then exits the annealing station.

Figure 3:
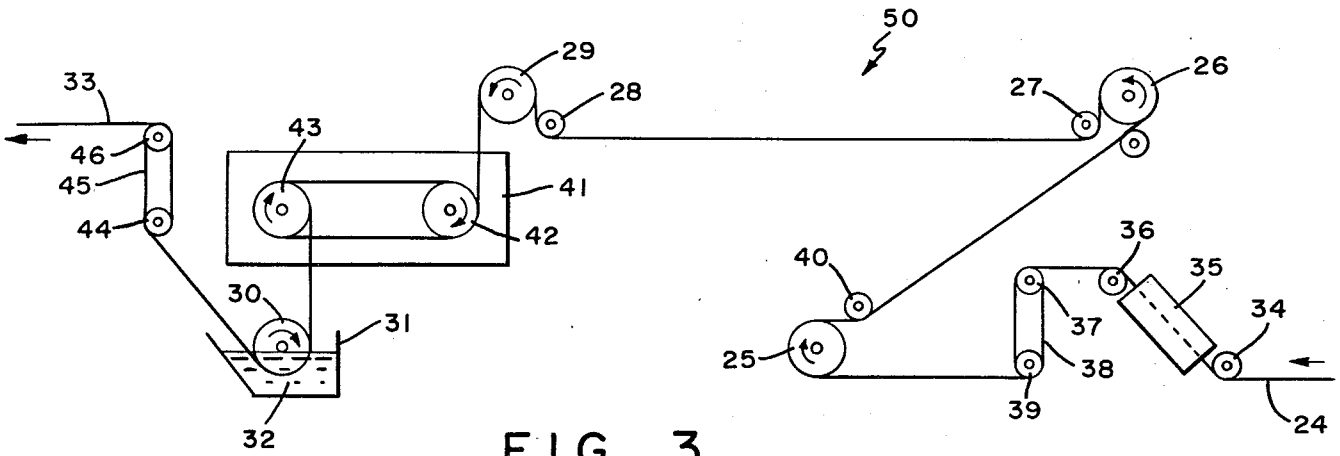
FIG. 3 is a diagram of a preferred apparatus for heat treatment of a continuously advancing wire which includes an added heat treatment holding zone in accordance with the present invention.

The improved apparatus for carrying out continuous, in-line annealing of elongate materials, such as wire, according to a preferred embodiment of the present invention is shown schematically in FIG. 3. This configuration lends itself to retrofit on existing apparatus. The as-drawn wire 24 enters the improved annealer station 50, along a predetermined path and under tension so as to advance it along that path. The wire 24 passes partially around wire cleaner entry roll 34 and passes through a wire cleaner apparatus 35 wherein accumulated grease, oil, drawing lubricant and metal dust is removed from the wire 24. Wire cleaner exit roll 36 is provided to maintain the wire 24 on the predetermined path to and partially around first accumulator entry roll 37. Spaced apart from entry roll 37 is the first accumulator exit roll 39; a plurality of wire wraps 38 are taken around the two rolls 37, 39. The two rolls have parallel axes spaced apart in a common plane by, for example, a fluid cylinder, (not shown) their axes remaining always parallel. The first accumulator mechanism serves to maintain a constant tension on the entering, as-drawn, cleaned wire 24, accommodating line speed variations of the wire. From the first accumulator mechanism the wire 24 is advanced along the predetermined path to and partially around a first rotating sheave 25 through which electrical contact is made with the wire 24. The wire 24 exiting first rotating sheave 25 is deflected slightly by idler roll 40, which serves to reduce vibration of the wire and ensure positive contact with first rotating sheave 25. Wire 24 continues along its path to and partially around second rotating sheave 26 through which another electrical contact is made with the wire 24. Idler roll 27 deflects the wire 24 and also reduces wire vibration; the wire is advanced along its path from the periphery of idler roll 27 to and around idler roll 28, thence around third rotating sheave 29. Electrical contact with the wire is again made by third rotating sheave 29. In practice, the first sheave 25 and third sheave 29 may be placed at ground potential to avoid charging the wire before and after the annealer apparatus 50 at an electrical potential with respect to ground. The wire is thereafter advanced into a thermal treatment temperature holding apparatus comprising, for example but not limitation, an insulated chamber 41 containing a first multiple groove entry wheel 42 and a second multiple groove exit wheel 43 which wheels 42, 43 contain a multiplicity of wire wraps. The number of wraps selected determines the holding time for a given line speed. Herein is the heat treating temperature maintained at the desired temperature so as to ensure proper annealing of the wire. The temperature of the chamber may be regulated in various ways, including for example but not limitation, heating to the lower end of a range of annealing temperatures by a first means and adjusting the temperature of either the chamber or the wire within the range of annealing temperatures by a second means. The wire may, if desired, be further continuously advanced along its path to and through a quench apparatus such as that represented by quench roll 30 immersed in a quench trough 31 at least partially filled with a quenching fluid 32 of the desired temperature. Finally, the wire is advanced through a second accumulator apparatus comprising second accumulator entry roll 44 and exit wheel 46 having multiple wire wraps thereabout. The entry and exit wheel 44, 46 axes are spaced variably apart by a fluid cylinder and have parallel axes. The second accumulator is substantially similar to the first accumulator described hereinbefore. The heat treated, quenched wire 33 exits the heat treatment apparatus and is advanced along its predetermined path to further operations or coiling.

Figure 4:
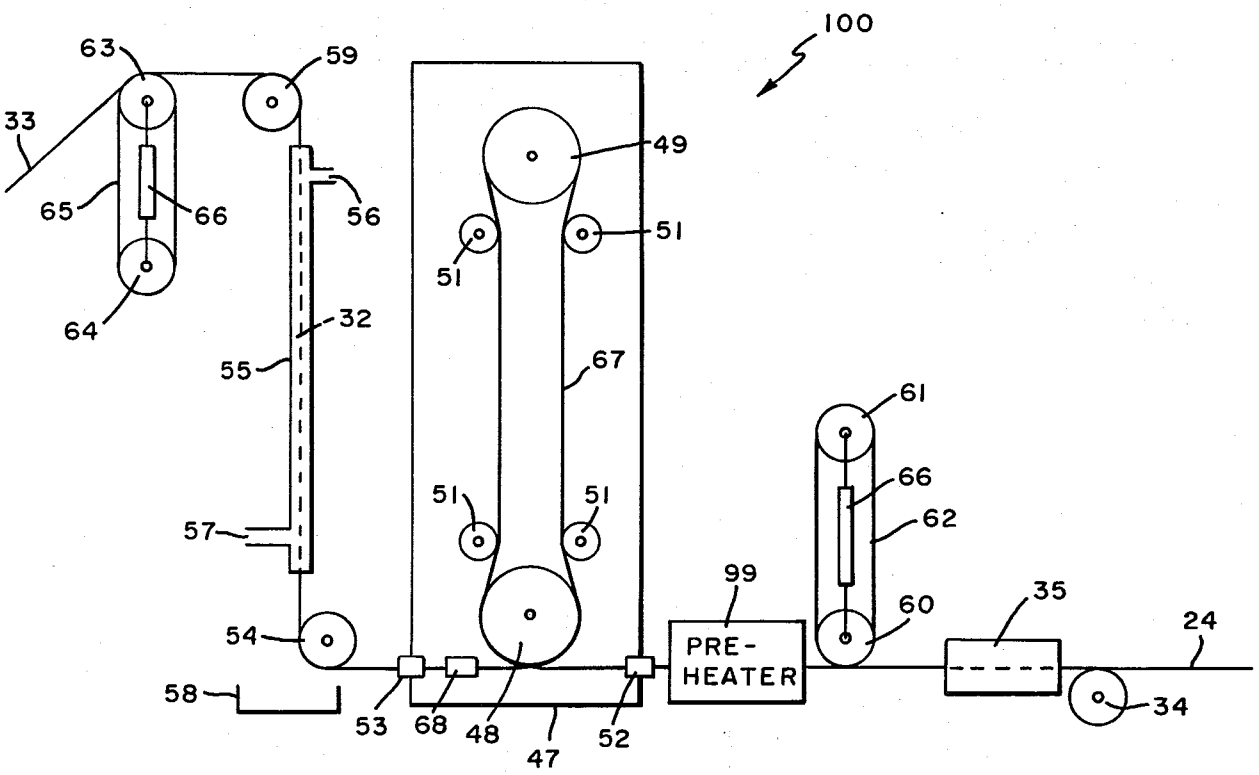
FIG. 4 is a diagram of an alternate apparatus for heat treatment of a continuously advancing wire which includes an integral heat treatment holding zone in accordance with the present invention.

FIG. 4 shows an alternate embodiment of the apparatus for heat treatment of a continuously advancing wire according to the present disclosure, in which preheating takes place in a first zone, then annealing is completed in a multiple-wrap configuration inside a heat retaining closed chamber. In the heat treatment apparatus 100 the entering wire 24 is guided by entry roll 34 into wire cleaner 35 while continuously advancing along its predetermined path under tension. The wire 24 proceeds through wire cleaner apparatus 35, from the exit of which it passes to first accumulator entry/exit roll 60 and tension roll 61, forming a multiplicity of wire wraps 62 therearound as previously described in association with similar apparatus in FIG. 3. The entry/exit and tension wheel axes are spaced variably apart by fluid cylinder 66 and have parallel axes. The wire 24 is advanced past the accumulator through a preheater 99 and then to and through a closed heat treatment device comprising a closed, insulated chamber 47 having an entrance 52, around first rotating multiple groove drum 48 electrically connected to a remote first electrical potential (not shown), around second rotating multiple groove drum 49 electrically connected to a second electrical potential (not shown) thus completing an electrical circuit path wherein current flows through and is dissipated in the wire 24 through electrical resistance heating effects, a plurality of idle rollers 51 urged individually against a plurality of wire wraps 67 around the drums 48, 49 and fitting in the grooves (not shown) thereof, a temperature sensor 68, and a chamber exit 53. In an alternate embodiment, the insulated chamber 47 may be heated by a hot fluid or a hot fluid in combination with electrical resistance heating of the wire 24. Continuously advanced along its predetermined path, the wire 24 passes partially around quench unit entry guide sheave 54, passes in counterflow relation through a quench fluid 32 passed downward by gravity or otherwise through quench tube 55 having inflow entrance 56 and outflow exit 57 and catch trough 58 located below entry guide sheave 54. Exiting quench tube 55, the wire 24 continues along its path partially around quench unit exit guide sheave 59, and is advanced to a second accumulator substantially similar to the first accumulator and comprising entry/exit roll 63 and tension roll 64 with a multiplicity of wire wraps 65 engaged in the grooves of the drums 63, 64. Fluid cylinder 66 maintains the parallel axes of the two rolls 63, 64 in a spaced apart relationship. The exiting wire 33 is thus continuously advanced throughout the apparatus and may be subjected to both warm and cool heat treatments therein.

Various methods and combinations of heating may be used to anneal the wire, including a hot fluid, electrical resistance, and/or both. Control of the temperature, for example but not limitation, may be accomplished by heating the wire 24 and/or chamber 47 to a desired annealing temperature and monitoring the ambient or wire temperature by temperature sensor 68, then adjusting the ambient or wire temperature as appropriate to maintain the desired temperature values within the desired annealing range. For the purposes of this invention, hot fluids include gases, liquids, and molten salt baths.

INDUSTRIAL APPLICABILITY

The present invention is most useful in adapting exiting thermal treatment apparatus for high speed, continuous wire use wherein the thermal treatment accorded an aluminum or aluminum alloy wire may be carefully regulated to optimize the electrical and mechanical properties of the wire.

I claim:

1. Improved high speed aluminum-base alloy wire thermal treatment apparatus including at least two rotating electrical contact sheaves for contacting a continuously advancing elongate metallic wire material following a predetermined path which includes at least partial traversals around said rotating electrical contact sheaves, adjustable electrical current supply source means connected to said rotating electrical contact sheaves such that said continuously advancing elongate metallic wire material completes the electrical circuit to said adjustable current supply source means, the improvement characterized wherein the electrical current supply source has a high average to peak voltage ratio and including in combination therewith an elongate material accumulator enclosed in a chamber, further including therein first means for elevation of the temperature of the wire to a temperature within a first temperature range and second means for elevation of the temperature of the wire to a temperature within a higher, narrow second temperature range within the chamber, to maintain the temperature of said continuously advancing elongate metallic wire material at a desired elevated temperature for an extended period of time.

2. The improved high speed wire thermal treatment apparatus of claim 1, wherein at least one of said wire temperature elevation means includes means for the passage of an electrical current through substantially that portion of said continuously advancing elongate metallic wire material accumulated in the chamber.

3. The improved high speed wire thermal treatment apparatus of claim 1, wherein at least one of said wire temperature elevation means includes a hot fluid.

4. The apparatus of claim 3, wherein said hot fluid is a gas.

5. The apparatus of claim 3, wherein the hot fluid is a liquid.

6. The apparatus of claim 3, wherein the hot fluid is a molten salt bath.

* * * * *